United States Patent [19]

Poldervaart

[11] Patent Number: 4,580,986

[45] Date of Patent: Apr. 8, 1986

[54] MOORING SYSTEM COMPRISING A FLOATING BODY HAVING STORAGE CAPACITY E.G. A TANKER AND A BUOY ANCHORED TO THE SEA BOTTOM

[75] Inventor: Leendert Poldervaart, La Turbie, France

[73] Assignee: Single Buoy Moorings, Inc., Marly, Switzerland

[21] Appl. No.: 515,551

[22] Filed: Jul. 19, 1983

[51] Int. Cl.[4] ..... B63B 21/52

[52] U.S. Cl. ..... 441/5; 114/230

[58] Field of Search ..... 405/218-221, 405/224; 114/230; 441/3-5

[56] References Cited

U.S. PATENT DOCUMENTS

| | | | |
|---|---|---|---|
| 2,882,536 | 4/1959 | Jordan | 441/4 |
| 3,155,069 | 11/1964 | Ross et al. | 114/230 |
| 3,193,318 | 7/1965 | Guerrant | 114/230 X |
| 3,464,466 | 9/1969 | Bryan | 405/218 X |
| 3,572,408 | 3/1971 | Hnot | 405/218 X |
| 3,916,812 | 11/1975 | Bartels | 441/3 X |
| 4,148,107 | 4/1979 | Karl et al. | 114/230 X |
| 4,193,368 | 3/1980 | DeGraaf et al. | 114/230 X |
| 4,280,430 | 7/1981 | Wilson et al. | 441/3 X |
| 4,396,046 | 8/1983 | Kentosh | 114/230 X |
| 4,490,121 | 12/1984 | Coppens et al. | 114/230 X |

FOREIGN PATENT DOCUMENTS

| | | | |
|---|---|---|---|
| 60991 | 4/1982 | Japan | 114/230 |
| 8200358 | 8/1982 | Netherlands | 114/230 |
| 2103166 | 2/1983 | United Kingdom | 114/230 |

*Primary Examiner*—Cornelius J. Husar
*Assistant Examiner*—Nancy J. Stodola
*Attorney, Agent, or Firm*—Weiser & Stapler

[57] ABSTRACT

A mooring system in the form of a floating body having storage capacity e.g. a tanker has been provided at one end, such as the bow with a forwardly extending arm having an opening through which a buoy can be lifted and placed with outwardly extending lugs upon supporting recesses of the parts of the arm which define the opening there between by moving the raised buoy forwardly and lowering it with its lugs in the said recesses. This allows a fast connection and disconnection, so that in case the tanker is in danger due to ice or bad weather, the tanker can move away. After return of the normal situation the connection can be restored easily by lifting the buoy out of the water and placing it in its supports without the need of operating additional locking means. A plurality of vessels having the same arm can be connected one at the time with this buoy.

13 Claims, 6 Drawing Figures

MOORING SYSTEM COMPRISING A FLOATING BODY HAVING STORAGE CAPACITY E.G. A TANKER AND A BUOY ANCHORED TO THE SEA BOTTOM

BACKGROUND OF THE INVENTION

Mooring systems of the type comprising a tanker or the like as well as a buoy are known in many forms. The buoy can have anchoring means in the form of chains or in the form of pivotable arms. Between tanker and buoy a connection has to be made, such that tanker and buoy can follow the movements imparted to them by wind and waves independent of ech other or by connecting the buoy to the tanker in such a way, that the buoy follows the movement of the tanker entirely. To this end it is known to provide the tanker with an outwardly extending arm and to move the buoy out of the water and give it a releasable connection with said arm. Examples of said prior art solutions are found in U.S. Pat. No. 3,572,408 and German Patent Specification No. 2,752,266. Accorrding to U.S. Pat. No. 3,572,408 the connection is made by lifting the anchoring means out of the water by increasing its buoyancy and bring its connecting means in the right position by means of a lifting line, the connection being finally performed by radially inwardly moving pistons, which enclose a spherical universal joint. It will be clear that during operation this joint is under permanent movement. According to the German Specification No. 2,752,266 the buoy is lifted out of the water by means of a winch and moved into the forkshaped opening between two outwardly extending arms and locked in place by means of hydraulic locking cylinders. According to said prior art a quick disconnection is possible, in that problems can arise if the flow lines passing from the vessel to the buoy are not disconnected first. Moreover, said quick release connecting systems require maintenance.

SUMMARY OF THE INVENTION

The present invention aims at a construction in the connection of tanker and buoy such that the connecting means need to maintenance, whilst connection and disconnection can be performed in an easy and fast way. However, not that fast and in a way such that the required disconnection of the flow lines could be overlooked.

According to the invention this is achieved in that the outwardly extending structure has the form of two interconnected arms defining an opening therebetween said arms being attached to the tanker and with their connection at a distance from the tanker, said arms and interconnection having a supporting recess or recesses open at the top of the buoy, whilst the buoy has been provided with outwardly extending lugs, which lugs fit into said recesses, the said arms defining an opening between the tanker and the parts with the recesses of the arms of a size such that the lug carrying portion of the buoy may pass through it and moved subsequently forwardly to become lowered with the lugs into said recesses.

Due to this principle a buoy can be easily lifted out of the water, moved upwardly through the opening between the arms and then moved forwardly and lowered to rest with its lugs in the recesses of arms and interconnecting part. Said arm and interconnecting part are in general an U-shaped element attached to the tanker. Any number of recesses and lugs can be used provided they extend in different directions such that the forces acting on the buoy in the horizontal plane can be taken up. Preferably three recesses and lugs are used; one in the centre of the interconnecting parts of the arms and one in each arm, the recess in the interconnecting parts having its axis in the longitudinal direction of the tanker and the two others their axis in a transverse direction. The cross section of recesses and lugs can be V-shaped or half-cylindrical. Preferred is an embodiment with three lugs and recesses respectively in which the lugs have a trapezoidal cross section in a horizontal plane as well as in a vertical plane whilst the recesses are correspondingly shaped. These lugs and recesses are again preferably combined with a lug and recess respectively in the interconnecting part which is rectangular in horizontal as well as vertical cross section.

This construction allows easy shifting in place of the buoy with its lugs in the recesses and once placed is irremovably locked against horizontal displacements. Preferably lugs and/or recesses are coated with a resin.

The invention now will be further elucidated with reference to the drawings, wherein.

Figure 1:
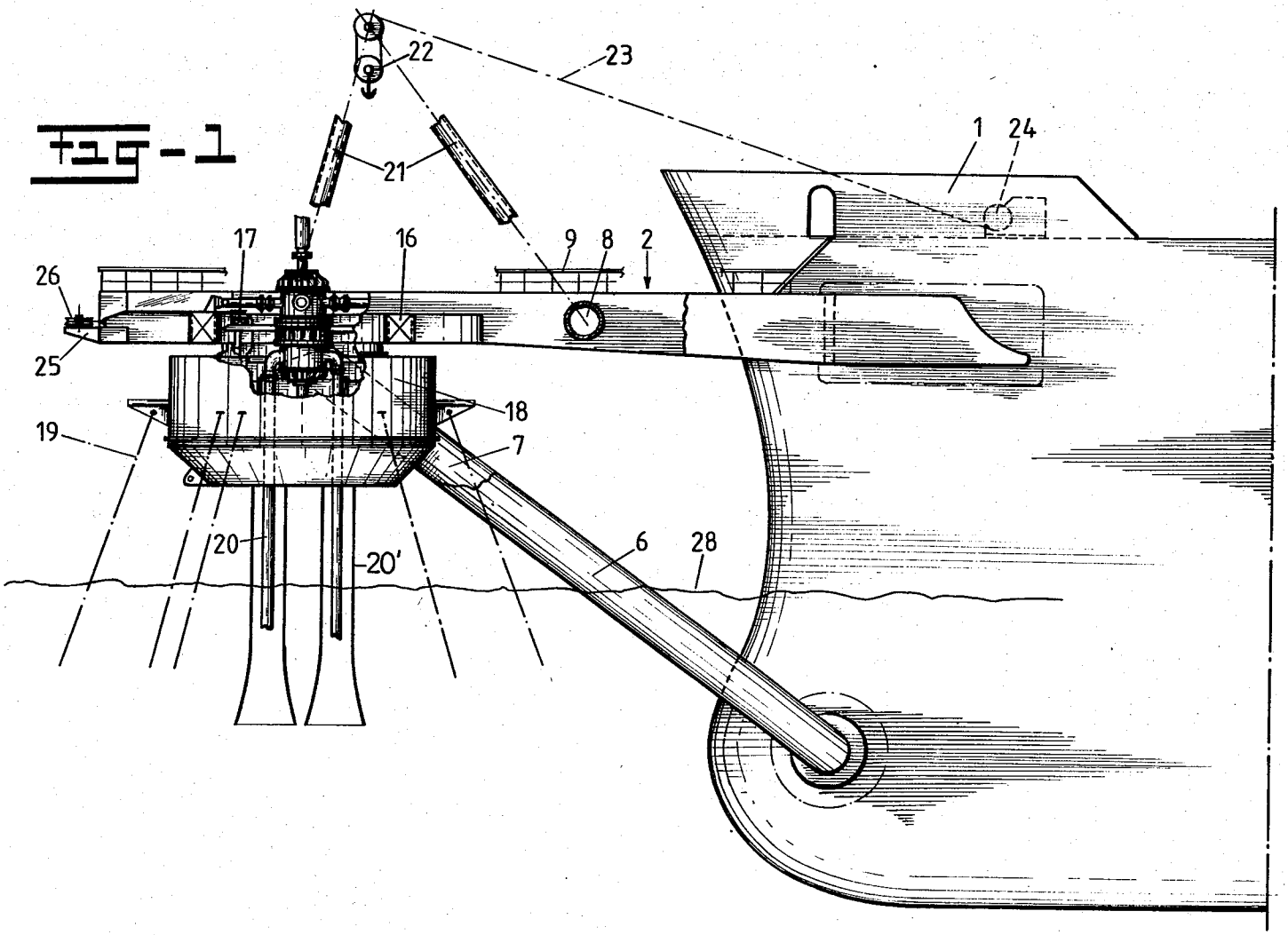
FIG. 1 is a schematic side view of the mooring system according to the invention.
Figure 2:
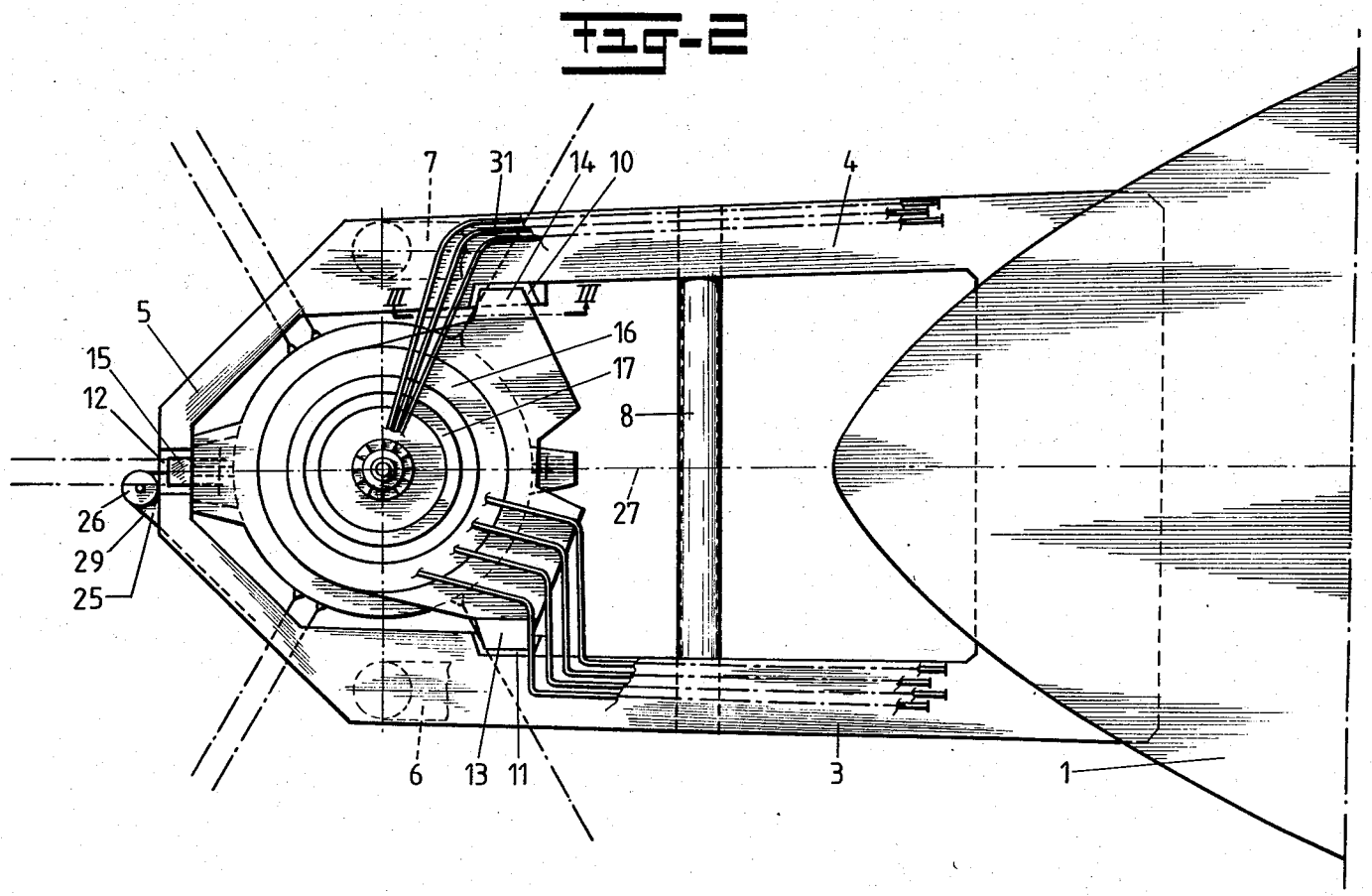
FIG. 2 is a top view of the arrangement of FIG. 1.

FIGS. 1 and 2 show the bow portion 1 of a tanker. Rigidly connected to said bow portion 1 is an element 2, formed by the arms 3 and 4 and the interconnecting part 5. Arms 3 and 4 as well as part 5 together form an in general U-shaped structure the outer portion of which further being supported by two downwardly extending bars 6 and 7. Between the arms 3 and 4 a tubular connection 8 has been provided. The entire U-shaped structure 3, 4, 5 has a box-shaped structure with a flat top surface allowing the access for personnel and provided with a fence 9.

The arms 3 and 4 respectively are provided with recesses 10, 11 and part 5 with a recess 12, supporting the outwardly extending lugs 13, 14 and 15 of a turntable 16, which by means of an annular roller bearing 17 forms part of a buoy 18, carrying a plurality of anchor lines 19 and under-water-hoses 20 provided with protecting trumpets 20'.

The structure 3, 4, 5 is carrying a hoisting device formed by a derrick schematically indicated at 21 and carrying a tackle 22 with a hoisting line 23 running towards a winch 24 on board of the tanker.

The front end of the interconnecting part 5 has a short extension 25 with a disk 26 for the cable of a winch, which cable can be connected to the front lug 15 of the turntable 16 of the buoy.

Figure 3:
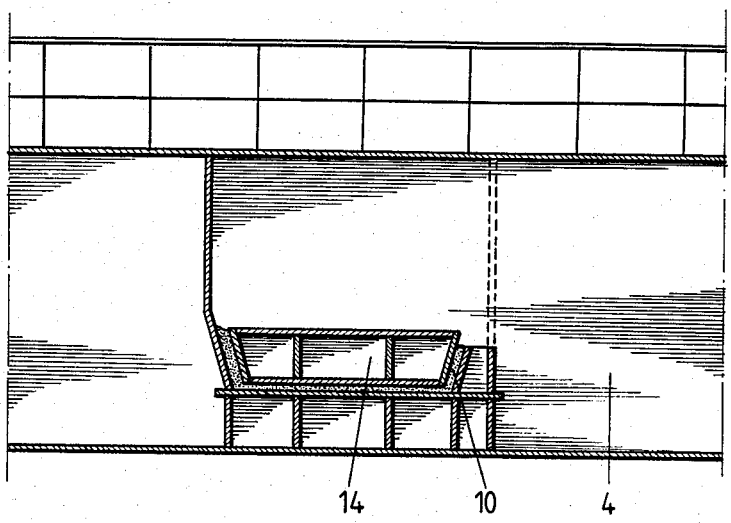
FIG. 3 is a cross section according to III—III in FIG. 2.

FIG. 3 discloses that the lug 14 has a trapezoidal cross section in a vertical plane parallel to the longitudinal axis 27 of the tanker.

From the top view of FIG. 2 it is clear that the lugs 13 and 14 also have a trapezoidal shape in a horizontal plane.

It further allows from FIGS. 2 and 3 that the recesses are shaped correspondingly.

Figure 4:
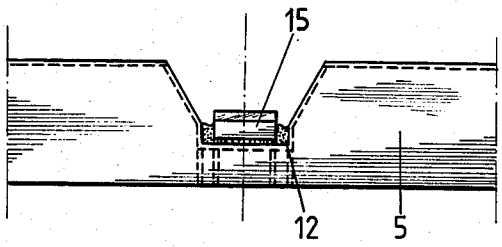
FIG. 4 is a front view of a part of FIG. 1.

The front lug 15 as appears from FIGS. 1 and 4, has a substantially rectangular cross section in a plane perpendicular to the axis 27 as well as a rectangular section in a vertical plane through said axis 27. The recess 12 is shaped correspondingly.

The drawings clearly show that there is a large clearance between the bottom wall and side wall of the recesses and the walls of the lugs to be placed in said recesses. Said clearance can be filled with suitable material, such as rubber or resin applied prior to the assembly to the operative surfaces of the recesses and/or lugs respectively. It, however, is also possible to apply a resin at the moment the buoy is placed with its lugs into the recesses which resin may harden, so that after hardening no clearance exists at all. If care is taken the resin does not adhere to one or the other of the cooperating surfaces of recesses and lugs, then a clearance-free connection is obtained which still allows fast disconnection.

If a connection has to be performed the buoy 18 floating at the water level 28 is connected with the tackle 22 and lifted out of the water into a position in which the lugs 13, 14 are on the right side in FIG. 2 of the recesses 11 and 10 respectively and lug 15 is in front of recess 12. With the side winch cable 29 running over disk 26 the buoy then is moved forwardly with lug 15 entering recess 12 and lugs 13 and 14 moving above recesses 11 and 10 respectively. When the buoy then is lowered it immediately is in its proper position, after which the connecting lines generally indicated at 30 and 31 can be made by using quick connecting couplings.

For disconnection said couplings are disconnected, the buoy is lifted again and upon being lifted will automatically swing rearwardly, therewith coming free from the supporting recesses and then can be lowered onto the water surface.

This is a fast operation, but does not prevent the operator from overlooking whether the couplings 30 and 31 are disconnected or not.

Figure 5:
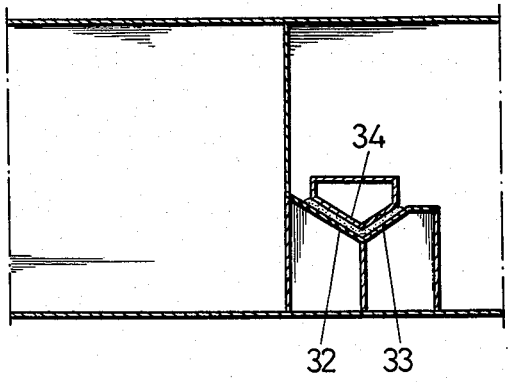
FIG. 5 shows in way comparable with FIG. 3 an alternative solution for the shape of lugs and recesses in the arms as well as for the interconnecting part.

FIG. 5 shows a V-shaped cross section for the cooperating surfaces of recess and lugs the recess accordingly having only side walls 32 and 33 and the lugs a V-shaped underside 334.

Figure 6:
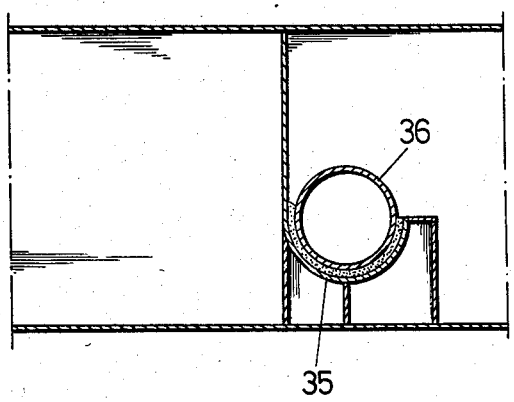
FIG. 6 shows another alternative solution for the shape of lugs and recesses.

FIG. 6 shows a half-circular recess bottom 35 for a lug 36 which may be cylindrical.

I claim:

1. Mooring system comprising a tanker or similar floating storage system, as well as a buoy connected to the sea bottom by means of anchoring means, said tanker having an outwardly extending structure forming a support for the buoy when lifted out of the water and placed in said structure by means of winch operated lifting means on the tanker, said structure comprising two interconnected arms attached to the tanker and with their interconnection at a distance from the tanker, said arms and interconnection having a supporting recess or recesses open at the top for the buoy, whilst the buoy has outwardly extending lugs, which lugs fit into said recesses, the said arms defining an opening between the tanker and the supporting recesses of the arms of a size such that the lug carrying portion of the buoy may pass through it.

2. Mooring system as claimed in claim 1 wherein the arms and interconnecting parts which define the said opening are provided with three supporting recesses for the buoy, one in the center of the interconnecting part and one in each arm, each recess in each arm having a bottom and/or side walls and an end wall whilst the buoy has three lugs which fit into the said recesses.

3. Mooring system as claimed in claim 2 wherein the recess in the center of the interconnecting part has only a bottom and/or side walls.

4. Mooring system as claimed in claim 2 wherein the laterally extending lugs have a trapezoidal cross sectional shape in a horizontal plane as well as in a vertical plane parallel to the said longitudinal axis of the tanker and in which the recesses in the arms are correspondingly shaped.

5. Mooring system as claimed in claim 2 wherein the portion of the front lug to be in contact with the bottom and side walls of the front recess has a rectangular cross section in a horizontal plane as well as in a vertical plane perpendicular to the said axis and in which the recess in the interconnecting part is correspondingly shaped.

6. Mooring system as claimed in claim 1 wherein the recesses are V-shaped in vertical cross section and the lugs are correspondingly shaped.

7. Mooring system as claimed in claim 1 wherein the recesses have a curved bottom and the lugs are correspondingly shaped.

8. Mooring system as claimed in claim 1 wherein the buoy has been provided with a turntable rotatable by means of an annular bearing about a vertical axis with respect to said buoy, said turntable being provided with the said lugs which extend outwardly.

9. Mooring system as claimed in claim 1 wherein the walls of the said recesses and/or the lugs are coated with a resin.

10. Mooring system comprising a floating storage means and a buoy connected to the sea bottom by anchoring means, said floating storage means having an outwardly extending structure forming a support for the buoy when lifted out of the water by winch operated lifting means associated with the tanker, said structure comprising two interconnected arms attached to and extending from the floating storage means to an interconnection at a distance from said floating storage means to define an opening therebetween, and said buoy comprising a plurality of outwardly extending lugs, wherein said interconnected arms and said interconnection have supporting recesses open at the top for receiving the lugs of said buoy, and wherein said opening is of a size such that the lug carrying portion of the buoy is capable of passing through it.

11. Mooring system as claimed in claim 10 wherein said system further comprises winch means associated with said interconnection, and wherein said winch means is capable of drawing said buoy from a first position in said opening to a second position wherein the lugs of said buoy are in registration with said supporting recesses.

12. Mooring system as claimed in claim 10 wherein said supporting recesses are positioned at spaced locations surrounding said opening.

13. Mooring system as claimed in claim 10 wherein said interconnected arms are rigidly associated with said floating storage means, and one another.

* * * * *